US007714853B2

(12) United States Patent
Su

(10) Patent No.: US 7,714,853 B2
(45) Date of Patent: May 11, 2010

(54) DISPLAY DEVICE AND METHOD THEREOF

(75) Inventor: Chi-Ming Su, Taipei (TW)

(73) Assignee: Realtek Semiconductor Corp., Hsinchu (TW)

( * ) Notice: Subject to any disclaimer, the term of this patent is extended or adjusted under 35 U.S.C. 154(b) by 852 days.

(21) Appl. No.: 11/407,226

(22) Filed: Apr. 20, 2006

(65) Prior Publication Data

US 2006/0244767 A1 Nov. 2, 2006

(30) Foreign Application Priority Data

Apr. 21, 2005 (TW) ..... 94112757 A

(51) Int. Cl.
*G09G 5/00* (2006.01)

(52) U.S. Cl. ..... 345/204; 345/213

(58) Field of Classification Search ..... 345/204, 345/213, 212

See application file for complete search history.

(56) References Cited

U.S. PATENT DOCUMENTS 5,111,190 A 5/1992 Zenda
5,710,570 A * 1/1998 Wada et al. ..... 345/3.2
5,796,392 A * 8/1998 Eglit ..... 345/213
5,953,074 A 9/1999 Reddy
6,014,126 A * 1/2000 Nishihara ..... 345/698
6,459,426 B1 * 10/2002 Eglit et al. ..... 345/213
2002/0113781 A1 * 8/2002 Ishiyama ..... 345/204
2003/0025687 A1 * 2/2003 Shino et al. ..... 345/204
2004/0001053 A1 * 1/2004 Myers ..... 345/204
2004/0075653 A1 * 4/2004 Shiuan et al. ..... 345/204
2004/0212609 A1 * 10/2004 Igarashi ..... 345/204

* cited by examiner

*Primary Examiner*—Amare Mengistu
*Assistant Examiner*—Premal Patel
(74) *Attorney, Agent, or Firm*—Thomas, Kayden, Horstemeyer & Risley

(57) ABSTRACT

A display device and its method are proposed in the present invention. First, at least one input parameter sent from a host is received and the display device then produces an output image according to the input parameter for displaying the output image. The display device includes a scaling module and a digital display module. The scaling module receives the input parameter. Next, the scaling module receives an input image sent from the host to produce the output image in accordance with the input parameter. Finally, the output image is transmitted to the digital display module to display the output image.

22 Claims, 3 Drawing Sheets

DISPLAY DEVICE AND METHOD THEREOF

BACKGROUND OF THE INVENTION

1. Field of the Invention

The present invention is related to a display device and its method, and more particularly, to a display device and method that can speedily acquire the parameters to show images and thus improve the efficiency.

2. Description of Related Art

Nowadays, the digital display devices are capable of receiving analog images and converting these analog images into digital images for displaying. In order to perform the analog-to-digital converting step, a clock (SCLK) for sampling the analog images is needed. In the prior arts, the clock is obtained by using a synchronization processor to process a horizontal synchronous signal (Hsync) and a vertical synchronous signal (Vsync) and consequently generates the characteristics such as the frequencies of Hsync and Vsync, the polarities of Hsync and Vsync, and the number of Hsync pulses between two Vsync signals (Vtotal), etc. Once the characteristics of Hsync and Vsync are realized, the resolution of the image is estimated and then the clock can be obtained (SCLK=Htotal*Vtotal*(frequency of Vsync)).

However, the estimated resolution may be wrong or may not be obtained in some cases. For example, when the characteristics of Hsync are the same as those of Vsync, the resolution cannot be estimated. Besides, a complicated firmware and a large memory space may be necessary for estimating the resolution such that time for estimating the resolution and hardware cost increase.

SUMMARY OF THE INVENTION

An objective of the present invention is to provide a display device and a related method for solving the fore-mentioned problems.

An objective of the present invention is to provide a display device and a method thereof to display images according to parameters from a host.

For achieving the objectives above, the present invention provides a display device and a method thereof. An input image and at least one input parameter sent from a host are first received and the display device thus obtains the input parameter directly to display the image. The display device includes a scaling module and a digital display module. First, the scaling module receives the input parameter. Next, the scaling module receives the input image to produce an output image in accordance with the input parameter. Finally, the digital display module displays the output image.

Numerous additional features, benefits and details of the present invention are described in the detailed description, which follows.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF PREFERRED EMBODIMENTS

Figure 1:
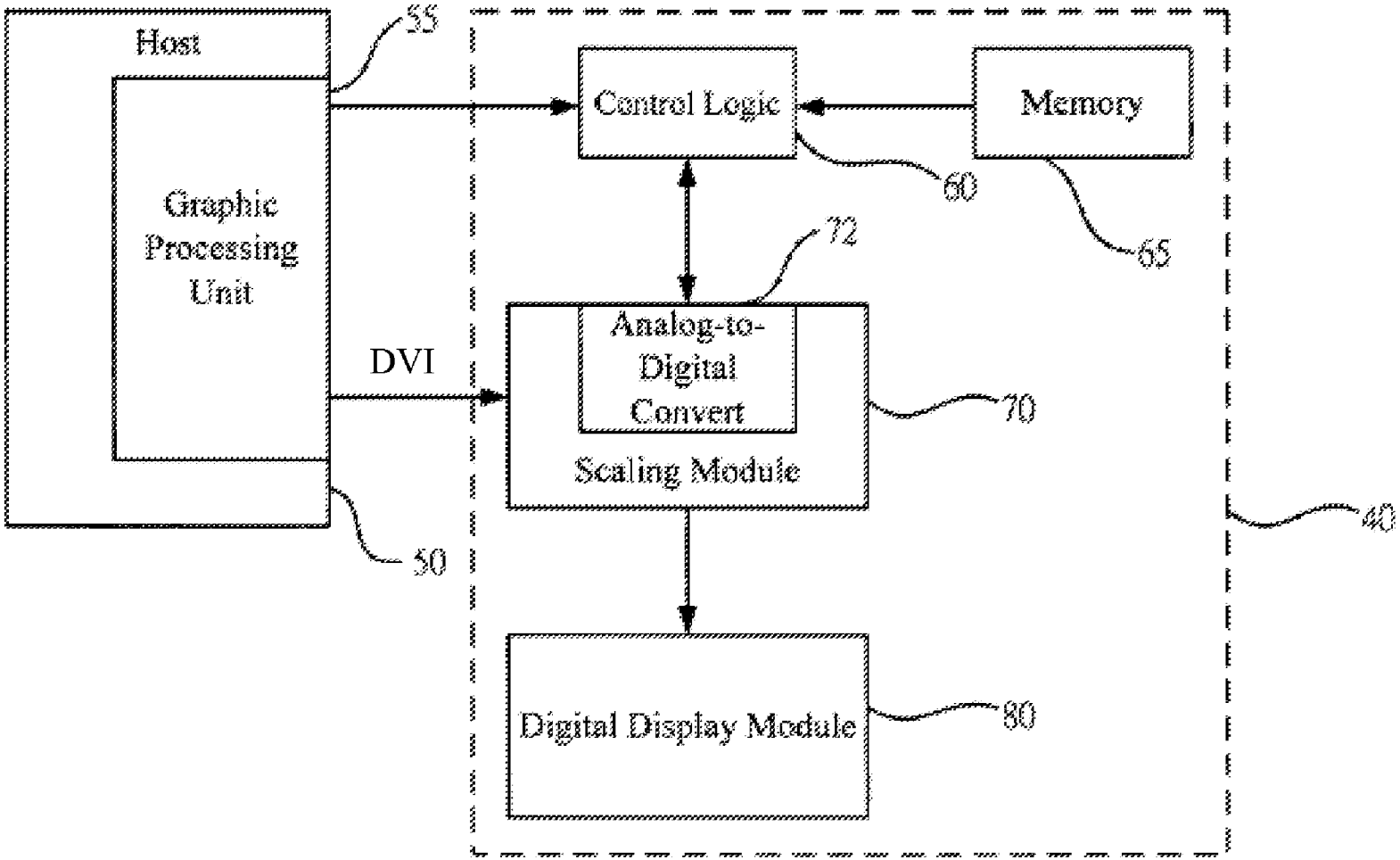
FIG. 1 is a block diagram of an embodiment in accordance with the present invention.

Reference is made to FIG. 1, which is a block diagram of an embodiment in accordance with the present invention. As shown in FIG. 1, the display device 40 is coupled with a host 50 to display images. The host 50 includes a graphic processing unit (GPU) 55. An example of the graphic processing unit (GPU) 55 is a video graphics array (VGA) card. The display device 40 includes a control logic 60, a scaling module 70 and a digital display module 80. The control logic 60 receives at least one input parameter sent from the GPU 55, where the input parameter comprises at least one of the resolution of an input image, the frequency of a horizontal synchronous signal, the frequency of a vertical synchronous signal, the polarity of the horizontal synchronous signal, the polarity of the vertical synchronous signal, the horizontal start position for displaying an output image, the vertical start position for displaying the output image, the number of pulses of a proposed input clock between two pulses of the horizontal synchronous signal, the number of pulses of the horizontal synchronous signal between two vertical synchronous signal, and an input type, which represents a separate form or a composite form, of the input image. After the control logic 60 receives at least one input parameter sent from the GPU 55, it generates a setting parameter according to the input parameter. The control logic 60 is coupled with a memory 65, which stores a firmware that is used to control the control logic 60.

In an embodiment of the present invention, the GPU 55 can transmit the input image to the scaling module 70 via a VGA interface. The input images include red (R), green (G) and blue (B) image data. The scaling module 70 includes an analog-to-digital convert (ADC) 72 to receive the analog signals of the input images transmitted from the GPU 55. The scaling module 70 receives the setting parameter generated by the control logic 60 and then produces an input clock and an output clock, in which the input clock is substantially the same as the proposed input clock. Then, the ADC 72 samples the analog signals of the input images according to the input clock and thus converts them into digital signals. After that, the scaling module 70 processes the digital signals of the input images to produce the output images and send the output images to the digital display module 80 according to the output clock to display the output images. Compared with the conventional display device, the display device of the present invention can acquire the correct input parameter from the GPU 55 and use it to produce the correct input clock. Thus, the present invention can display the images correctly.

In another embodiment, the GPU 55 transmits the input images to the scaling module 70 via a digital visual interface (DVI). Since the input images sent from the DVI are digital images, this embodiment doesn't need to use the ADC 72 to sample the input images. As the above embodiment, the scaling module 70 of this embodiment receives the setting parameter generated by the control logic 60 and then produces the input clock and the output clock. After that, the scaling module 70 processes the digital input images to produce the output images and send the output images to the digital display module 80 according to the output clock to display the output images.

Figure 2:
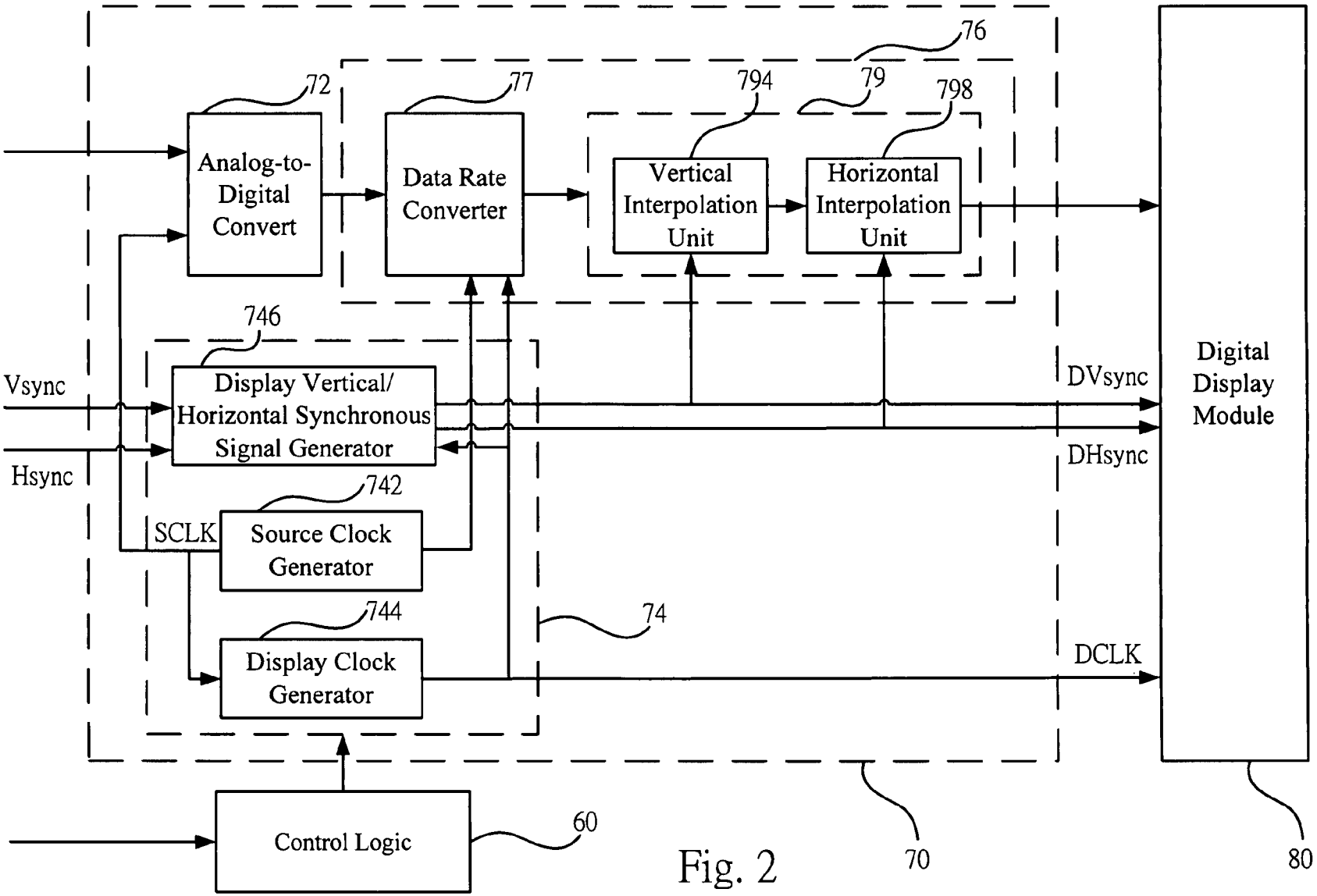
FIG. 2 is a block diagram of an embodiment of the scaling module in accordance with the present invention.

The reference is made to FIG. 2, which is a block diagram of an embodiment of the scaling module in accordance with the present invention. As shown in FIG. 2, the scaling module 70 includes the ADC 72, a clock-generating unit 74 and a scaling unit 76. The clock-generating unit 74 includes a source clock generator 742, a display clock generator 744 and a display vertical/horizontal synchronous signal generator 746. The scaling unit 76 includes a data rate converter 77 and a vertical/horizontal interpolation module 79. The vertical/horizontal interpolation module 79 further has a vertical interpolation unit 794 and a horizontal interpolation unit 798.

The source clock generator 742 of the clock-generating unit 74 produces a source clock SCLK according to the setting parameter sent from the control logic 60. The control logic 60 receives the input parameters sent from the GPU 55 and then generates the setting parameter accordingly. The display clock generator 744 produces a display clock DCLK according to the source clock SCLK and the setting parameter. Therein, the source clock SCLK and the display clock DCLK are the input clock and the output clock respectively. Furthermore, the display vertical/horizontal synchronous signal generator 746 produces a display horizontal synchronous signal DHsync and a display vertical synchronous signal DVsync according to the horizontal synchronous signal Hsync and the vertical synchronous signal Vsync sent from the GPU 55 and the display clock DCLK sent from the display clock generator 744. The clock-generating unit 74 and the control logic 60 mentioned above are integrated as a clock control module. It means that the scaling module 70 can includes the control logic 60.

The ADC 72 is used to sample the analog input images according to the source clock SCLK and thereby output the digital input images to the data rate converter 77 of the scaling unit 76. The data rate converter 77 receives the digital input images according to the source clock SCLK and outputs the digital images to the vertical/horizontal interpolation module 79 according to the display clock DCLK. The vertical/horizontal interpolation module 79 is used for up-scaling the input images to produce the output images and transmits the output images to the digital display module 80 according to the display horizontal synchronous signal DHsync and the display vertical synchronous signal DVsync to display the output images, it means that the vertical/horizontal interpolation module 79 outputs the output mages according to the display clock DCLK because the display horizontal synchronous signal DHsync and the display vertical synchronous signal DVsync are produced according to the display clock DCLK.

The digital display module 80 displays the output images according to the display horizontal synchronous signal DHsync, the display vertical synchronous signal DVsync and the display clock DCLK. The data rate converter 77 and vertical/horizontal interpolation module 79 are well known by people in this field. Thus, these two components are not detailed. If the input images sent from the GPU 55 are digital, the ADC 72 can be omitted.

The present invention can be applied for the host 50 or the display device 40 for activation, changing the display mode or executing various display functions, such as the function for auto-tuning the display window or making the images displayed completely fill the display frame. When the host 50 is turned on, the display mode of the host 50 is changed or various display functions of the host 50 are performed, the GPU 55 of the host 50 automatically transmits the input parameter to the display device 40 to display images.

In addition, the present invention can also be applied when the display device 40 is turned on, the display mode of the display device 40 is changed or various display functions of the display device 40 are performed. The display device 40 can automatically obtain the input parameter from the GPU 55. It means that display device 40 can obtain the input parameter via the GPU 55. For example, the display device 40 can automatically send a request signal out to make the GPU 55 provide the input parameter. The action for sending the request signal can be performed via the control logic 60.

According to the description above, since the present invention can directly obtain the input parameters, such as the resolution of input images, the frequency of the horizontal synchronous signal, the frequency of the vertical synchronous signal, the polarity of the horizontal synchronous signal, the polarity of the vertical synchronous signal, the horizontal start position for displaying the output image, the vertical start position for displaying the output image, the number of pulses of the proposed input clock between two pulses of the horizontal synchronous signal and the number of pulses of the horizontal synchronous signal between two vertical synchronous signal, and the input type of the input image, from the GPU 55 of the host 50, the input parameters obtained in the present invention must be correct and can be acquired speedily. Thus, the present invention is unlike the prior art, which needs to detect and process the vertical synchronous signals and the horizontal synchronous signals sent from the GPU 55 to obtain the input parameters. Besides, the input parameters obtained in the prior art still have a probability to be erroneous. Hence, the present invention simplifies the programming of the firmware and reduces the memory space necessary for the firmware. Furthermore, the present invention can display images speedily.

Furthermore, when the display device 40 of the present invention performs the auto tune function, the control logic 60 directly obtains the horizontal start position for displaying the output image, the vertical start position for displaying the output image and clock, from the GPU 55. Thus, the control logic 60 only needs to detect and determine the phase for sampling the analog input images. Hence the programming of the firmware is simplified, the memory space for storing the firmware is saved and the reaction time for performing the auto tune function is shortened. The input parameters transmitted from the GPU 55 mentioned above can be sent according to the requirements of the display device 40 for executing various display functions and displaying images. Besides, the present invention can also be used for a digital television.

Figure 3:
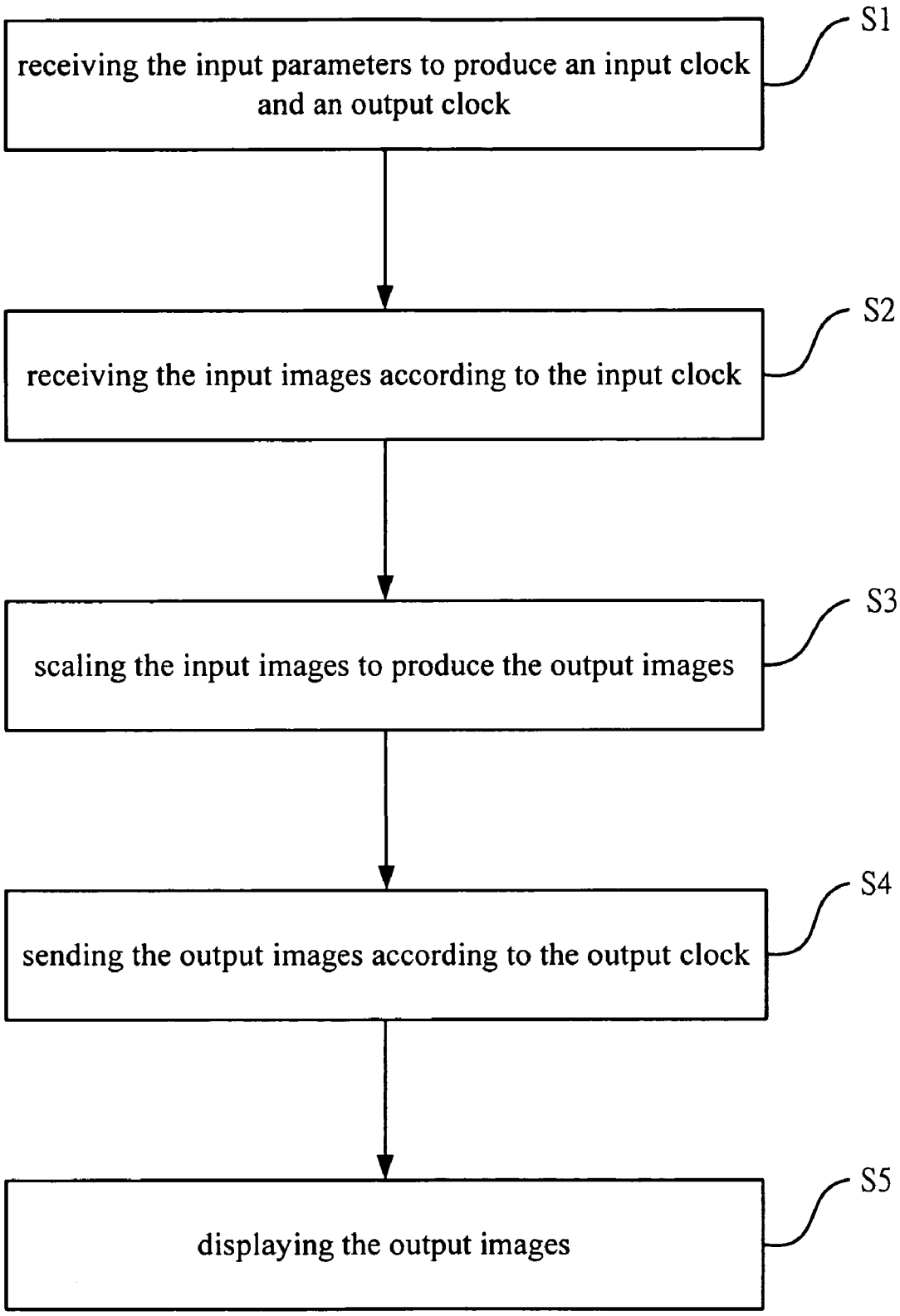
FIG. 3 is a flow chart of a preferred embodiment in accordance with the present invention.

Reference is made to FIG. 3, which is a flow chart of a preferred embodiment in accordance with the present invention. When the host 50 or the display device 40 is turned on, the display mode of the host 50 or the display device 40 is changed or various display functions of the host 50 or the display device 40 are performed, step S1 is performed. In step S1, the input parameters sent from the GPU 55 of the host 50 are received by the display device 40. When the host 50 is turned on, the display mode of the host 50 is changed or various display functions of the host 50 are performed, the GPU 55 of the host 50 automatically transmits the input parameters to the display device 40. When the display device 40 is turned on, the display mode of the display device 40 is changed or various display functions of the display device 40 are performed, the control logic 60 of the display device 40 automatically obtains the input parameters from the GPU 55. It means that the control logic 60 of the display device 40 automatically sends a request signal to the GPU 55 to make the GPU 55 provide the input parameters for the display device 40. The control logic 60 generates the setting parameters corresponding to the input parameters received and transmits them to the scaling module 70 to produce an input clock and an output clock, i.e. the source clock SCLK and the display clock DCLK.

After that, the scaling module 70 performs step S2 to receive the input images according to the input clock. If the input images are analog, the ADC 72 of the scaling module 70 samples the input images according to the input clock to produce the corresponding digital input images. Then, the digital input images are transmitted to the scaling unit 76. Therein, the scaling unit 76 receives the input images sent from the ADC 72 according to the input clock. Next, the scaling unit 76 performs step S3 to perform the scaling process on the input images to produce the output images. Then, as shown in step S4, the output images are sent to the digital display module 80 according to the output clock. Finally, as shown in step S5, the digital display module 80 receives the output images and then displays the output images.

To sum up, the display device and its method provided in the present invention obtain the input parameters directly from the host 50 to display images and execute various display functions. Thus, the present invention does not cause the problem when the images are displayed. Besides, since the present invention does not need to perform a detecting process and a calculating process to obtain the input parameters, it reduces the reaction time for activating the display device 40 or changing the display mode. Hence, the speed of displaying images is increased.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are embraced within the scope of the invention as defined in the appended claims.

What is claimed is:

1. A display device for receiving an input image and at least one input parameter from a host to provide an output image, comprising:

a clock control module for receiving the input parameter and producing an input clock and an output clock accordingly, wherein the clock control module comprises:

a control logic configured to receive the at least one input parameter and produce a setting parameter; and a clock-generating unit configured to produce the input clock based on the setting parameter, and wherein the clock-generating unit generates the output clock based on the setting parameter and the input clock;

a scaling unit coupled to the clock control module for receiving the input image according to the input clock, scaling the input image to produce the output image, and outputting the output image according to the output clock; and a digital display module coupled to the clock control module and the scaling unit to receive the output image and the output clock to display the output image;

wherein the at least one input parameter comprises at least one of a resolution of the input image, a frequency of a horizontal synchronous signal, a frequency of a vertical synchronous signal, a polarity of the horizontal synchronous signal, a polarity of the vertical synchronous signal, a horizontal start position for displaying the output image, a vertical start position for displaying the output image, a number of pulses of a proposed input clock between two pulses of the horizontal synchronous signal, and a number of pulses of the horizontal synchronous signal between two vertical synchronous signal.

2. The display device as claimed in claim 1, wherein the host comprises a graphic processing unit (GPU) for outputting the input image and the input parameter.

3. The display device as claimed in claim 2, wherein the display device sends a request signal to the GPU and the GPU provides the input parameter according to the request signal.

4. The display device as claimed in claim 1, wherein the control logic is further coupled to a memory, the memory stores a firmware that is used to control the control logic.

5. The display device as claimed in claim 1, wherein the scaling unit is further coupled to an analog-to-digital converter (ADC), which is used to receive an analog input image and sample the analog input image according to the input clock to provide a digital input image for the scaling unit.

6. The display device as claimed in claim 1, wherein the input image is digital, which is transmitted to the scaling unit via a digital visual interface (DVI).

7. The display device as claimed in claim 1, wherein the input clock is substantially the same as the proposed input clock.

8. A display method, applied for a display device, the display method comprising:

receiving a plurality of input parameters from a host to produce a setting parameter;

producing an input clock based on the setting parameter;

producing an output clock based on the setting parameter and the input clock receiving an input image from the host according to the input clock;

scaling the input image to produce an output image;

outputting the output image according to the output clock; and displaying the output image according to the output clock;

wherein the input parameters comprise: a resolution of the input image, a frequency of a horizontal synchronous signal, a frequency of a vertical synchronous signal, a polarity of the horizontal synchronous signal, a polarity of the vertical synchronous signal, a horizontal start position for displaying the output image, a vertical start position for displaying the output image, a number of pulses of a proposed input clock between two pulses of the horizontal synchronous signal, a number of pulses of the horizontal synchronous signal between two vertical synchronous signal, and an input type, which represents a separate form or a composite form, of the input image.

9. The display method as claimed in claim 8, wherein before the step of receiving the input parameter to produce the input clock and the output clock is performed, the display method further comprises:

sending a request signal to a graphic processing unit (GPU) of the host, wherein the GPU outputs the input parameter according to the request signal.

10. The display method as claimed in claim 8, wherein before the step of receiving the input image according to the input clock is performed, the display method further comprises: receiving the input image that is analog and sampling the analog input image according to the input clock to provide digital input image.

11. The display method as claimed in claim 8, wherein in the step of receiving the input image according to the input clock, the input image is digital and the digital input image is received via a digital visual interface (DVI).

12. The display method as claimed in claim 8, wherein the input clock is substantially the same as the proposed input clock.

13. A display device, which receives an input image and at least one input parameter from a graphic processing unit (GPU) to provide an output image, comprising:

a scaling module receiving the input image and the at least one input parameter to produce the output image; and a digital display module coupled to the scaling module to receive the output image and display the output image;

wherein the at least one input parameter comprises at least one of a resolution of the input image, a frequency of a horizontal synchronous signal, a frequency of a vertical synchronous signal, a polarity of the horizontal synchronous signal, a polarity of the vertical synchronous signal, a horizontal start position for displaying the output image, a vertical start position for displaying the output image, a number of pulses of a proposed input clock between two pulses of the horizontal synchronous signal, and a number of pulses of the horizontal synchronous signal between two vertical synchronous signal, and wherein the display device is configured to request the input parameter directly from the GPU.

14. The display device as claimed in claim 13, wherein the scaling module comprises:

a clock control module for receiving the input parameter and producing an input clock and an output clock accordingly; and a scaling unit coupled to the clock control module for receiving the input image according to the input clock, scaling the input image to produce the output image and outputting the output image according to the output clock.

15. The display device as claimed in claim 14, wherein the clock control module comprises a control logic and a clock-generating unit, the control logic receives the input parameter to produce a setting parameter correspondingly, the clock-generating unit receives the setting parameter to produce the input clock and the output clock.

16. The display device as claimed in claim 15, wherein the control logic is further coupled to a memory, the memory stores a firmware that is used to control the control logic.

17. The display device as claimed in claim 14, wherein the scaling unit is further coupled to an analog-to-digital converter (ADC), which is used to receive the input image that is analog and sample the analog input image according to the input clock to provide digital input image for the scaling unit.

18. The display device as claimed in claim 14, wherein the input clock is substantially the same as the proposed input clock.

19. The display device as claimed in claim 13, wherein the input image is digital, which is transmitted to the scaling module via a digital visual interface (DVI).

20. A display method, applied for a display device, the display method comprising:

requesting at least one input parameter from a graphic processing unit (GPU) and receiving the at least one input parameter directly from the GPU without intermediate processing;

receiving an input image from the GPU to produce an output image according to the at least one input parameter; and displaying the output image;

wherein the at least one input parameter comprises at least one of a resolution of the input image, a frequency of a horizontal synchronous signal, a frequency of a vertical synchronous signal, a polarity of the horizontal synchronous signal, a polarity of the vertical synchronous signal, a horizontal start position for displaying the output image, a vertical start position for displaying the output image, a number of pulses of a proposed input clock between two pulses of the horizontal synchronous signal, and a number of pulses of the horizontal synchronous signal between two vertical synchronous signal.

21. The display method as claimed in claim 20, wherein the step of receiving the input parameter further comprises:

receiving the input parameter to produce a setting parameter to generate the output image.

22. A display device for receiving an input image and at least one input parameter from a host to provide an output image, comprising:

a clock control module configured to receive the input parameter directly from a graphics processing unit (GPU) without intermediate processing and generate an input clock and an output clock, wherein the input parameter comprises at least one of a resolution of the input image, a frequency of a horizontal synchronous signal, a frequency of a vertical synchronous signal, a polarity of the horizontal synchronous signal, a polarity of the vertical synchronous signal, a horizontal start position for displaying the output image, a vertical start position for displaying the output image, a number of pulses of a proposed input clock between two pulses of the horizontal synchronous signal, and a number of pulses of the horizontal synchronous signal between two vertical synchronous signal; and a scaling unit coupled to the clock control module configured to receive the input image according to the input clock, wherein the scaling unit is further configured to scale the input image to produce the output image and output the output image according to the output clock.

* * * * *